US006827405B1

(12) United States Patent
Roberts

(10) Patent No.: US 6,827,405 B1
(45) Date of Patent: Dec. 7, 2004

(54) PORTABLE ARMREST FOR A CHAIR

(76) Inventor: Pierre Roberts, 1343 E. Olive Ave., Colton, CA (US) 92324

( * ) Notice: Subject to any disclaimer, the term of this patent is extended or adjusted under 35 U.S.C. 154(b) by 0 days.

(21) Appl. No.: 10/661,289

(22) Filed: Sep. 12, 2003

(51) Int. Cl.[7] ..... A47C 7/54
(52) U.S. Cl. ..... 297/411.23; 297/188.18
(58) Field of Search ..... 297/188.18, 149, 297/153, 411.23; 248/118

(56) References Cited

U.S. PATENT DOCUMENTS 1,247,547 A * 11/1917 Ko ..... 297/411.23
2,617,473 A * 11/1952 Krimstock et al. ..... 297/161
3,220,767 A * 11/1965 Hendrickson ..... 297/228.12
3,515,429 A * 6/1970 Bollinger ..... 297/153
4,109,887 A * 8/1978 Wakeland, Jr. ..... 5/678
4,576,351 A 3/1986 Brink ..... 248/118
5,060,638 A * 10/1991 Bodine, Jr. ..... 297/466
5,505,412 A * 4/1996 Van Hamme ..... 248/118
5,700,053 A * 12/1997 Downing ..... 297/227
5,722,713 A 3/1998 Santa Cruz et al. ..... 296/153
5,797,655 A 8/1998 Miles ..... 297/411.23
6,578,914 B2 * 6/2003 Artsvelyan ..... 297/219.1

* cited by examiner

*Primary Examiner*—Peter R. Brown
(74) *Attorney, Agent, or Firm*—Goldstein Law Offices, P.C.

(57) ABSTRACT

A portable armrest for use with an existing chair, for cushioning the arms of a user from the hard surfaces of the arms of the chair. The portable armrest has a soft, substantially rectangular pad, a rigid base attached to the lower surface of the pad, and a pair of U-shaped brackets attached to the lower surface of the base of the pad. The portable armrest is selectively attached to the arm of the existing chair by positioning the armrest above the upper surface of the arm of the chair and by pressing the armrest vertically downward, in order to engage the brackets with the arm of the chair. In an alternate embodiment, the armrest is additionally provided with a strap assembly for further securing the armrest to the arm of the chair.

7 Claims, 5 Drawing Sheets

PORTABLE ARMREST FOR A CHAIR

BACKGROUND OF THE INVENTION

1. Field of the Invention

The invention generally relates to an armrest, and in particular relates to a portable armrest which is selectively attachable to the arms of an existing chair.

2. Description of the Related Art

Many millions of individuals attend public or private events in which the individual is seated upon an existing chair while watching the events. Oftentimes, the chairs provided at these events have arms having hard surfaces, and it is therefore uncomfortable for the individual to rest period of time. Accordingly, there is a need for a portable armrest, selectively attachable to the arms of an existing chair, for cushioning the arms of an individual seated upon the chair from the hard surfaces of the arms of the chair.

A variety of armrests are available. For example, U.S. Pat. No. 4,576,351 to Brink appears to show an armrest suitable for use by a stroke victim that is capable of propping the victim's arm at an incline to prevent accumulation of fluids in the hand and wrist area. Additionally, U.S. Pat. No. 5,722,713 to Santa Cruz appears to show a removable armrest for attachment to the windowsill of a vehicle door. Furthermore, U.S. Pat. No. 5,797,655 to Miles appears to show an armrest which is selectively attachable to an arm of a chair, having a leg for supporting the arm rest upon a surface.

While these devices may be suitable for the particular purpose employed, or for general use, they would not be as suitable for the purposes of the present invention as disclosed hereafter.

SUMMARY OF THE INVENTION

It is an object of the invention to provide an armrest for an existing chair, which enables a user to sit in the chair comfortably for extended periods of time. Accordingly, the armrest has a soft pad which cushions the arms of the user from the hard surfaces of the arms of the chair, thereby enabling the user to sit in the chair comfortably for extended periods of time.

It is another object of the invention to provide an armrest which is easily and selectively attached to the arm of an existing chair. Accordingly, the armrest has two U-shaped brackets, each capable of selectively engaging the longitudinal sides and lower surface of the arm of the chair, thereby providing an armrest which is easily and selectively attached to the arm of the existing chair.

It is yet another object of the invention to produce a portable armrest which is not unduly expensive. Accordingly, the armrest is constructed from inexpensive materials and its cost is not prohibitive.

The invention is a portable armrest for use with an existing chair, for cushioning the arms of a user from the hard surfaces of the arms of the chair. The portable armrest has a soft, substantially rectangular pad, a rigid base attached to the lower surface of the pad, and a pair of U-shaped brackets attached to the lower surface of the base of the pad. The portable armrest is selectively attached to the arm of the existing chair by positioning the armrest above the upper surface of the arm of the chair and by pressing the armrest vertically downward, in order to engage the brackets with the arm of the chair. In an alternate embodiment, the armrest is additionally provided with a strap assembly for further securing the armrest to the arm of the chair.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
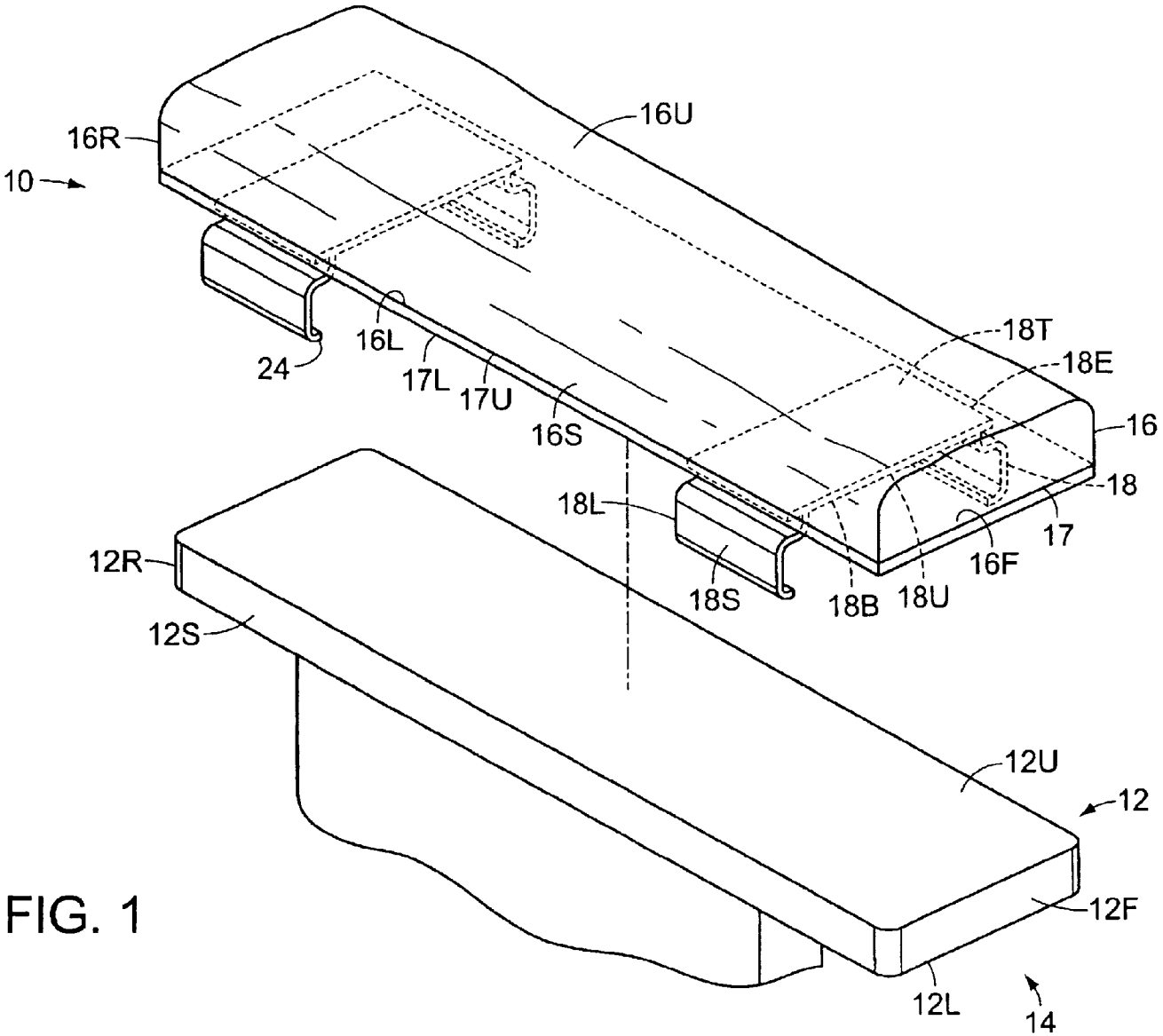
FIG. 1 is an exploded view of a first embodiment of a portable armrest positioned for attachment to an existing chair arm.

FIG. 1 illustrates a first embodiment of a portable armrest 10 positioned for attachment to an existing chair 14 having at least one arm 12. The portable armrest 10 comprises a substantially rectangular cushioned pad 16 having an upper surface 16U, a substantially flat lower surface 16L, two opposing lateral sides 16S, a front 16F, and a rear 16R. The pad 16 is substantially constructed from a soft, foam material. The portable armrest 10 has a substantially rectangular rigid base 17 having a lower surface 17L, and an upper surface 17U upon which the lower surface of the pad 16L is attached, in order to support the pad 16. The portable armrest 10 further comprises a pair of substantially U-shaped brackets 18, each having a substantially rectangular upper portion 18U having a top surface 18T and a bottom surface 18B. The top surface 18T has two opposing edges 18E. The top surface 18T of each bracket 18 is rigidly attached to the lower surface 17L of the base 17. The bottom surface 18B of the upper portion 18U of the bracket 18 has two opposing, flexible side portions 18S extending vertically downward therefrom, which together define an inside opening therebetween. Each side portion 18S has a lower portion 18L having an inwardly extending lip 24 extending therefrom. The lips 24 are opposed to each other. The flexible side portions 18S and the opposing lips 24 are used to center and firmly attach the portable armrest 10 to the arm 12 of the existing chair 14.

The substantially rectangular arm 12 of the chair 14 has an upper surface 12U, a lower surface 12L, two opposing longitudinal sides 12S, a front 12F, and a rear 12R, the arm 12 having a width between the longitudinal sides 12S.

The hatched line in FIG. 1 indicates the direction that the portable armrest 10 is installed onto the arm 12 of the chair 14 in order to selectively attach the portable armrest 10 to the arm 12. In particular, the portable armrest 10 is positioned above the upper surface 12U of the arm 12, with the two opposing flexible side portions 18S of each of the brackets 18 extending vertically downward toward the arm 12 alongside the longitudinal sides 12S of the arm 12. After selective attachment of the armrest 10 to the arm 12 of the chair 14, one of the brackets 18 is attached in proximity to the front 12F of the arm 12, and the other bracket 18 is attached in proximity to the rear 12R of the arm 12.

The portable armrest 10 is used by a user having at least one arm, in conjunction with a chair 14 having at least one arm 12, for cushioning the at least one arm of the user as it rests upon the at least one arm 12 of the chair 14. In general, most available existing chairs 14 have two arms 12. For such chairs 14, a portable armrest 10 would be selectively attached to each of the two arms 12 of the chair 14.

It is contemplated that the portable armrest 10 would be packaged and sold with an accompanying drawstring bag, in order to enable the user to easily transport and store the portable armrest 10. The portable armrest 10 may be provided in a variety of shapes and sizes so that it may be "snapped on" to a large variety of arms 12 on existing chairs 14. In particular, the portable armrest 10 is sized with an inside opening width between side portions 18S so that after slightly flexing the side portions 18S by pushing the portable armrest 10 in the direction of the hatched line shown in FIG. 1 to allow the opposing lips 24 to extend fully to the lower surface 12L of the arm 12, the side portions 18S rest flush against the longitudinal sides 12S of the arm 12. The side portions 18S are sized so that after attachment of the portable armrest 10 to the arm 12 of the existing chair 14, the opposing lips 24 firmly engage the lower surface 12L of the arm 12, and thereby prevent the portable armrest 10 from inadvertently slipping off of the arm 12 of the chair 14.

Figure 2:
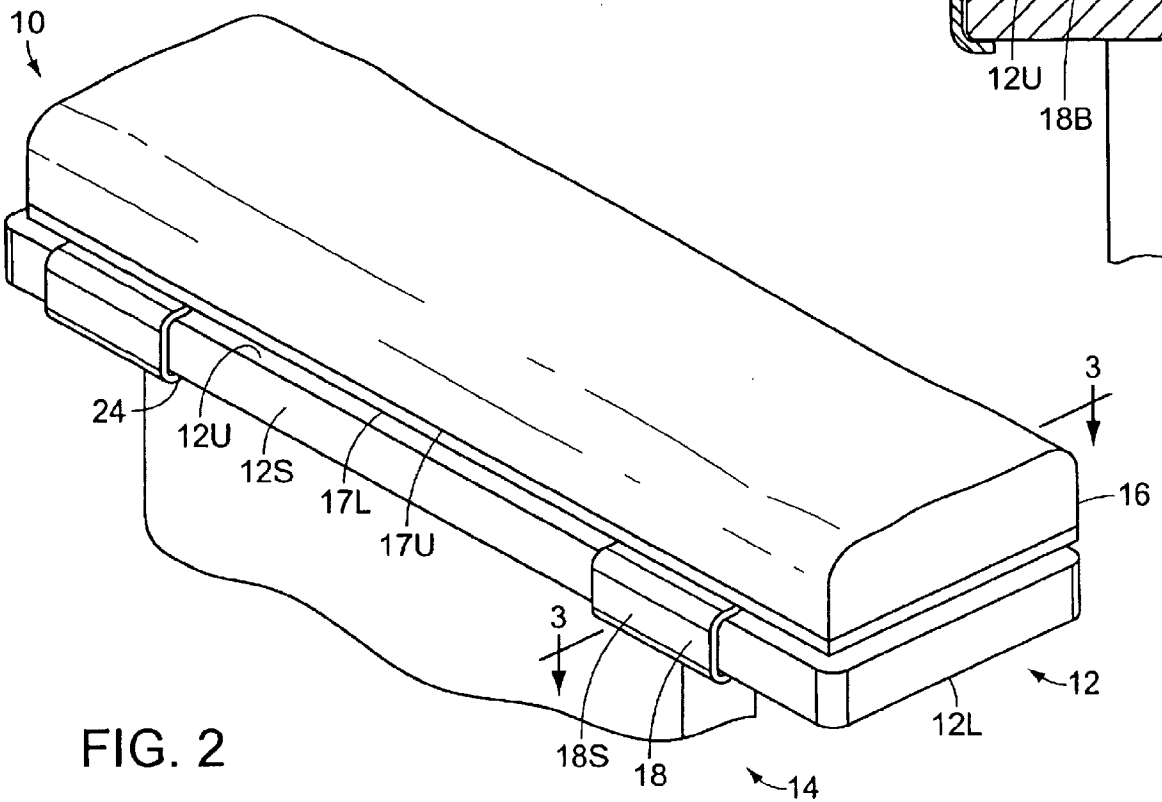
FIG. 2 is a perspective view of the first embodiment of the portable armrest after attachment to the existing chair arm.

FIG. 2 is a view of the first embodiment of the portable armrest 10 after attachment to the arm 12 of the existing chair 14 by "snapping on" the portable armrest 10 to the arm 12. The opposing side portions 18S of each of the U-shaped brackets 18 are substantially flush against the opposing longitudinal sides 12S of the arm 12. The lips 24, partially obscured in FIG. 2 by the arm 12 of the chair 14, firmly anchor the portable armrest 10 to the lower surface 12L of the arm 12.

Figure 3:
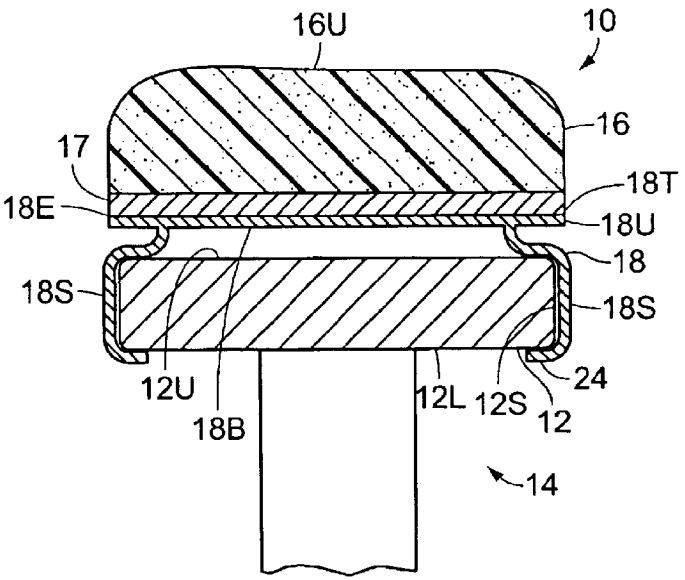
FIG. 3 is a cross-sectional view taken along line 3—3 of FIG. 2.

FIG. 3 is a cross-sectional view of the portable armrest 10 after selective attachment to the arm 12 of the existing chair 14. The lips 24 of one of the brackets 18 are seen to tightly engage the lower surface 12L of the arm 12, thereby preventing the portable armrest 10 from inadvertently slipping off of the arm 12 of the chair 14 during use. In combination, the opposing side portions 18S and the lips 24 of the portable armrest 10 bracket the longitudinal sides 12S and the lower surface 12L, respectively, of the arm 12 of the chair 14. As seen in FIG. 3, the bottom surface 18B of the upper portion 18U of the bracket 18 does not substantially contact the upper surface 12U of the arm 12. In an alternate embodiment, the bottom surface 18B of the upper portion 18U of the bracket 18 does substantially contact the upper surface 12U of the arm 12. In such an embodiment, in combination, the bottom surface 18B of the upper portion 18U, the opposing side portions 18S, and the lips 24 of the bracket 18 selectively engage the upper surface 12U, the longitudinal sides 12S and the lower surface 12L, respectively, of the arm 12 of the chair 14.

Figure 4:
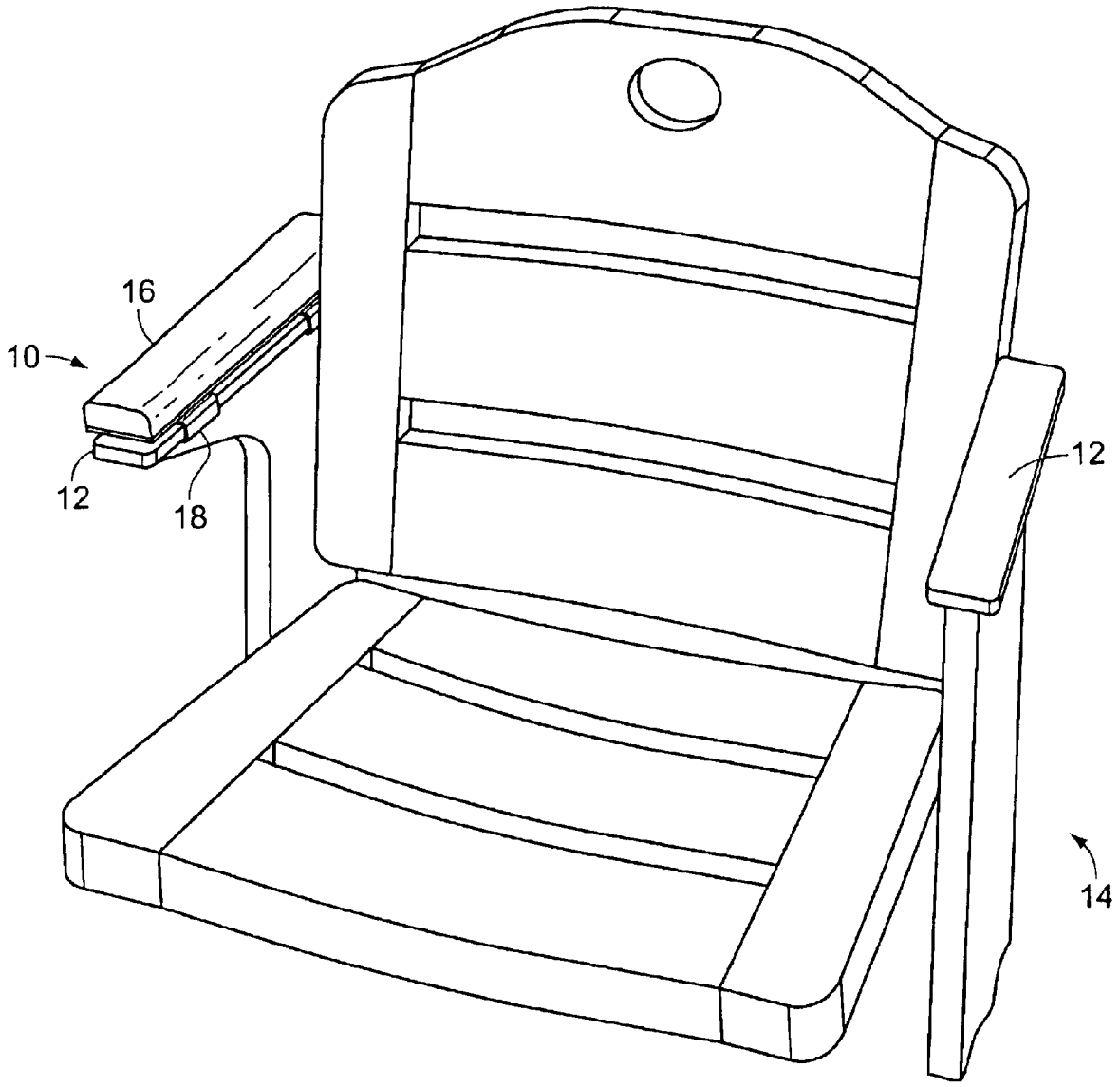
FIG. 4 is a perspective view of the first embodiment of the portable armrest after attachment to the existing chair arm.

FIG. 4 is a view of the first embodiment of the portable armrest 10 after attachment to the arm 12 of an existing chair 14 having two arms 12. Obviously, in use, an additional armrest 10 would generally be attached to the other arm 12 of the chair 14.

As described above, the portable armrest 10 may be pressed or "snapped on" to an arm 12 of an existing chair 14. Additionally, if the arm 12 has consistent width, the portable armrest 10 can be longitudinally slipped onto the arm 12 by extending the front 12F or rear 12R of the arm 12 through the inside opening defined by the opposing side portions 18S and the opposing lips 24 of the two brackets 18 of the portable armrest 10.

Figure 5:
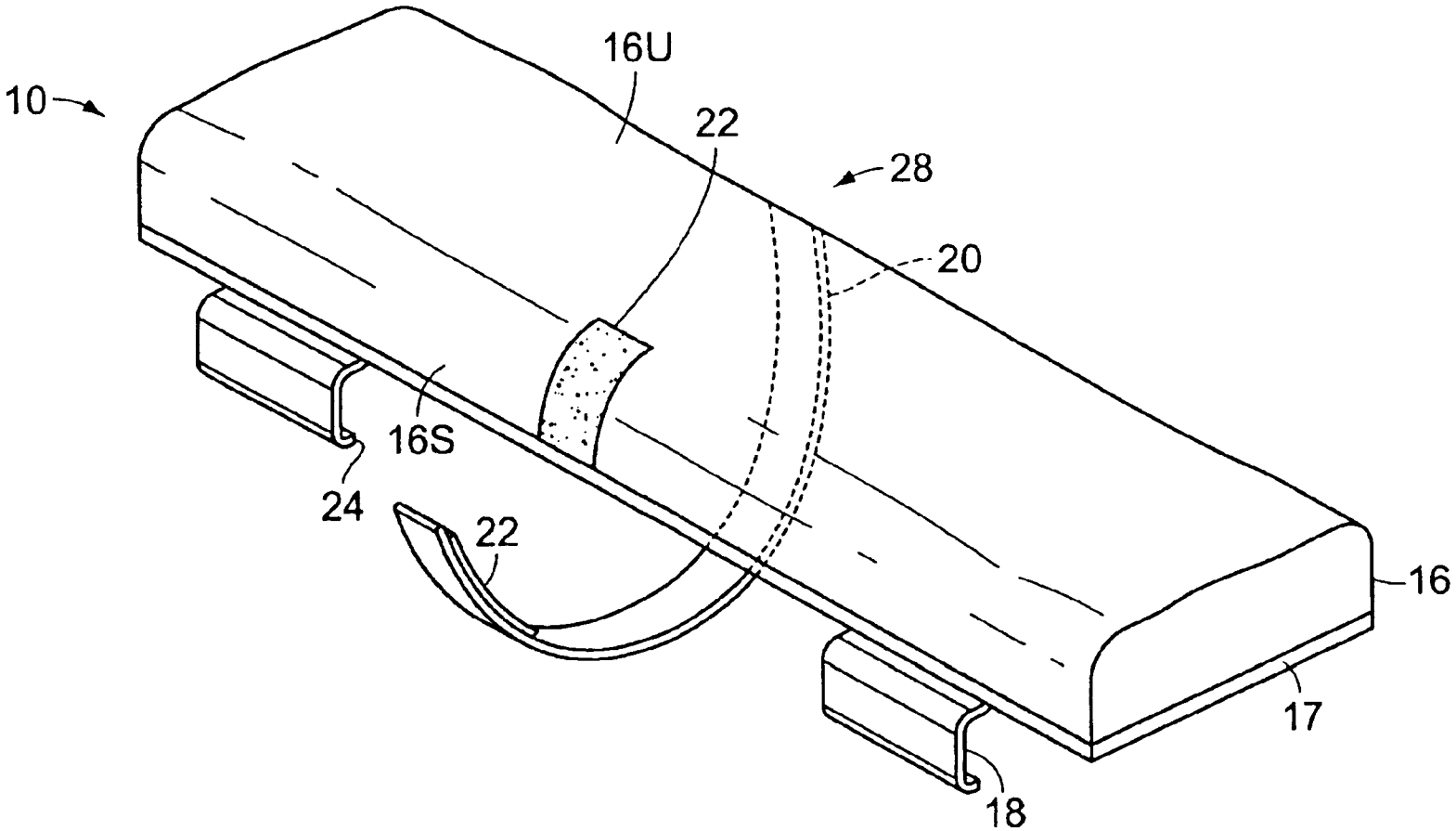
FIG. 5 is a perspective view of a second embodiment of the portable armrest, additionally having a strap assembly for selective attachment to an arm of a chair.
Figure 6:
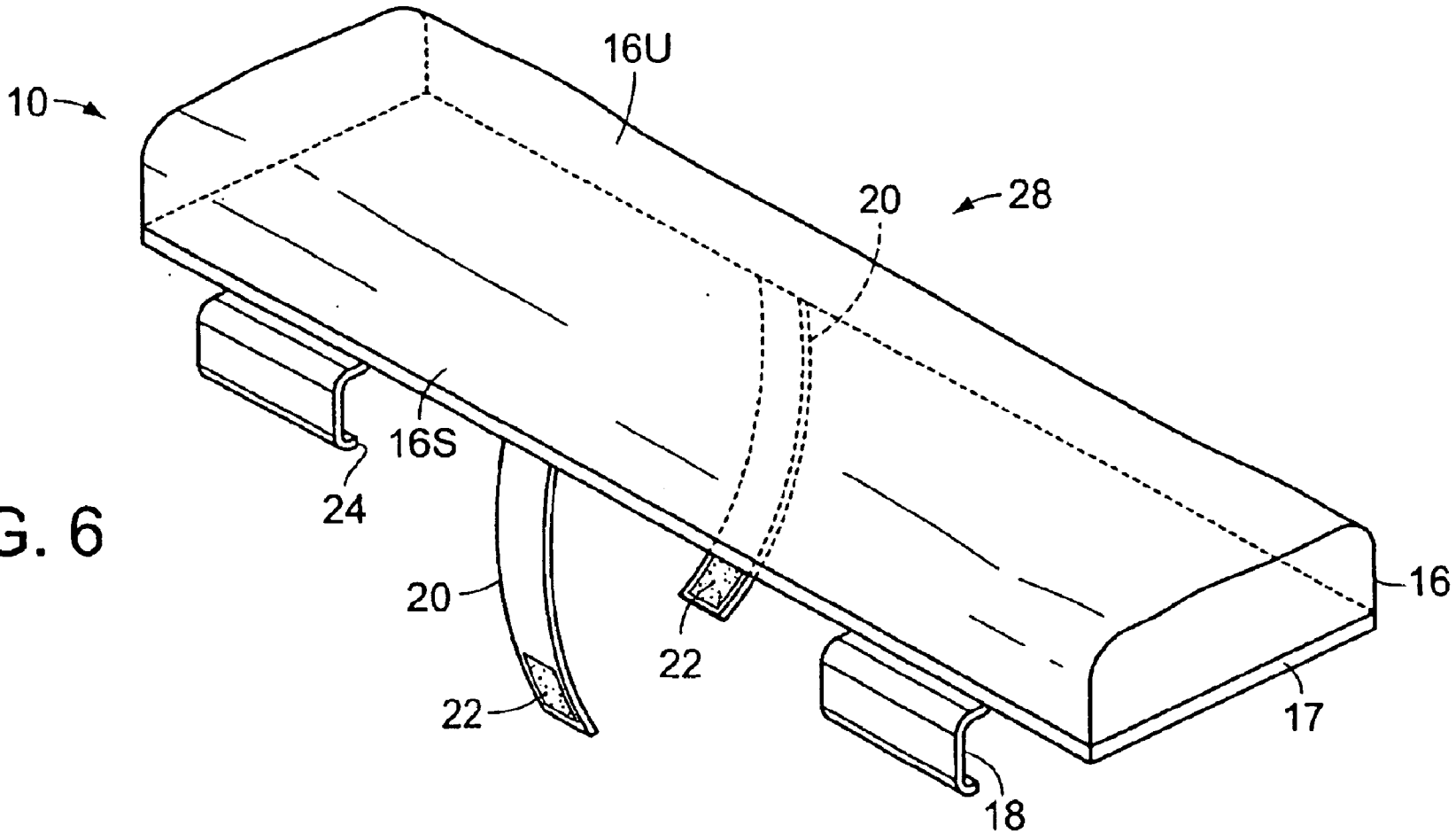
FIG. 6 is a perspective view of a third embodiment of the portable armrest, having a pair of opposing straps for selective attachment to an arm of a chair.

FIG. 5 illustrates a second embodiment of the portable armrest 10, having a pair of brackets 18, as in the first embodiment, but also having a strap assembly 28, having a strap 20 attached in proximity to one of the lateral sides 16S of the pad 16, and a strip 22 of fastening material attached in proximity to the other lateral side 16S of the pad 16. The strap 20 has an attached strip 22 of fastening material. In such an embodiment, the portable armrest 10 is selectively attached to the arm 12 of the chair 14 by the brackets 18, as in the first embodiment, but is also anchored to the arm 12 by wrapping the strap 20 around the lower surface 12L of the arm 12 and mating the strip 22 of fastening material on the strap 20 with the strip 22 of fastening material attached in proximity to one of the lateral sides 16S of the pad 16. In this embodiment, the lips 24 of the brackets 18 and the strap assembly 28 act together to keep the portable armrest 10 in place. In yet another embodiment, as shown in FIG. 6, the portable armrest 10 has a pair of opposing straps 20, wherein each of the straps 20 is attached in proximity to a different one of the lateral sides 16S of the pad 16, and wherein each strap 20 has an attached strip 22 of fastening material. In such an embodiment, the portable armrest 10 is selectively attached to the arm 12 of the chair 14, by use of the brackets 18 as described above, and additionally by wrapping the opposing straps 20 around the lower surface 12L of the arm 12 and mating the straps by mating the strip 22 of fastening material on one of the straps with the opposing strip of fastening material on the other strap.

In use, a user positions the first embodiment of the portable armrest 10 above the upper surface 12U of the arm 12 of the chair 14 and presses vertically downward, in order to selectively engage the lips 24 extending inwardly from the side portions 18S with the lower surface 12L of the arm 12. If a strap assembly 28 is provided, the portable armrest 10 is additionally attached to the arm 12 by wrapping the strap 20 around the lower surface 12L of the arm 12 and mating the strip 22 of fastening material on the strap 20 with the strip 22 of fastening material attached in proximity to one of the lateral sides 16S of the pad 16.

In conclusion, herein is presented a portable armrest for a chair, for cushioning the arms of a user while sitting in the chair. The invention is illustrated by example in the drawing figures, and throughout the written description. It should be understood that numerous variations are possible, while adhering to the inventive concept. Such variations are contemplated as being a part of the present invention.

What is claimed is:

1. A portable armrest, for a chair having at least one arm having an upper surface, a lower surface, two opposing longitudinal sides, a front, a rear, and a width between the longitudinal sides, for use by a user having at least one arm, for cushioning the at least one arm of the user while sitting in the chair, comprising:

a substantially rectangular pad substantially constructed from a soft material, having an upper surface, a substantially flat lower surface, two opposing lateral sides, a front, and a rear;

a substantially rectangular rigid base having a lower surface, and an upper surface upon which the lower surface of the pad is attached, said base for supporting the pad; and a pair of substantially U-shaped brackets, each having a substantially rectangular upper portion having a top surface and a bottom surface, said top surface having two opposing edges, two opposing flexible side portions, and two inwardly extending lips, wherein the top surface of each bracket is rigidly attached to the lower surface of the base, and wherein the flexible side portions of each bracket extend vertically downward from the bottom surface of the upper portion of the bracket, the flexible side portions define an inside opening therebetween having an inside opening width, wherein each side portion has a lower portion, the lip extending inwardly therefrom, wherein the lips are opposed to each other, wherein when extended upon an arm of a chair having a width substantially the same as the inside opening width, the opposing side portions of each bracket rest substantially flush against the opposing longitudinal sides of said at least one arm of said chair, and each of said pairs of opposing lips of each of said brackets tightly engage the lower surface of said at least one arm of the chair after pressing the portable armrest downward against the upper surface of said at least one arm of the chair, thereby preventing the portable armrest from inadvertently slipping off of said at least one arm of the chair during use.

2. The portable armrest as recited in claim 1, wherein the bottom surface of the upper portion of the brackets, the opposing side portions of the brackets, and the lips of the brackets selectively engage the upper surface, the longitudinal sides, and the lower surface, respectively, of the at least one arm of the chair.

3. The portable armrest as recited in claim 2, wherein the pad is substantially constructed from a foam material.

4. The portable armrest as recited in claim 3, further comprising a strap assembly, having a strap attached in proximity to one of the lateral sides of the pad, and a strip of fastening material attached in proximity to the other lateral side of the pad, wherein the strap has an attached strip of fastening material, wherein the portable armrest is selectively secured to the arm of the chair by wrapping the strap around the lower surface of the arm of the chair and mating the strip of fastening material on the strap with the strip of fastening material attached in proximity to the other lateral side of the pad.

5. The portable armrest as recited in claim 3, further comprising a strap assembly, having a pair of opposing straps, wherein each of the straps is attached in proximity to a different one of the opposing lateral sides of the pad, and wherein each strap has a strip of fastening material attached thereunto for mating the straps together, wherein the portable armrest is selectively attached to the arm of the chair by use of the brackets, and additionally by wrapping the opposing straps around the lower surface of the arm of the chair and mating the straps by mating the strip of fastening material on one of the straps with the opposing strip of fastening material on the other strap.

6. A method of using a portable armrest, by a user having at least one arm, in conjunction with a chair having at least one arm having an upper surface, a lower surface, two opposing longitudinal sides, a front, a rear, and a width between the longitudinal sides, for cushioning the at least one arm of the user while sitting in the chair, said portable armrest having a pad having an upper surface, a substantially flat lower surface, two opposing lateral sides, a front, a rear, said portable armrest also having a substantially rectangular rigid base having a lower surface and an upper surface upon which the lower surface of the pad is attached, said armrest additionally having a pair of substantially U-shaped brackets, each having a substantially rectangular upper portion having a top surface and a bottom surface, wherein the top surface of the bracket is rigidly attached to the lower surface of the base of the pad, and wherein the bottom surface of the upper portion of the bracket has two opposing, flexible side portions extending vertically downward therefrom, which together define an inside opening therebetween having an inside opening width, wherein each side portion has a lower portion, each having an inwardly extending lip extending therefrom, wherein the lips are opposed to each other, said method comprising the steps of:

positioning the portable armrest above the upper surface of the arm of the chair, with the two opposing side portions of each of the brackets extending vertically downward alongside the longitudinal sides of the arm of the chair;

attaching the portable armrest to the arm of the chair by engaging the lower surface of the arm of the chair with the lips extending from the lower portion of the side portions of the brackets by flexing and separating the side portions by pressing the portable armrest vertically downward against the upper surface of the arm of the chair, and moving the side portions downward alongside the longitudinal sides; and cushioning the at least one arm of the user by resting the at least one arm of the user upon the upper surface of the pad.

7. The method of using a portable armrest as recited in claim 6, wherein the step of attaching the portable armrest to the arm of the chair comprises attaching the portable armrest by longitudinally slipping the arm of the chair through the portable armrest by extending one of the longitudinal sides of the arm of the chair through the inside opening.

* * * * *